US008961697B2

(12) United States Patent
Sugio

(10) Patent No.: US 8,961,697 B2
(45) Date of Patent: Feb. 24, 2015

(54) DIE-MEMBER-CLEANING METHOD AND APPARATUS

(75) Inventor: Naoki Sugio, Fukuoka-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 860 days.

(21) Appl. No.: 12/520,916

(22) PCT Filed: Dec. 26, 2007

(86) PCT No.: PCT/JP2007/075024

§ 371 (c)(1),
(2), (4) Date: Jul. 22, 2009

(87) PCT Pub. No.: WO2008/078793

PCT Pub. Date: Jul. 3, 2008

(65) Prior Publication Data

US 2010/0012155 A1 Jan. 21, 2010

(30) Foreign Application Priority Data

Dec. 27, 2006 (JP) ..... 2006-352463

(51) Int. Cl.

| | |
|---|---|
| ***B08B 9/00*** | (2006.01) |
| ***B08B 9/093*** | (2006.01) |
| ***B08B 3/02*** | (2006.01) |
| ***B28B 7/38*** | (2006.01) |
| *B28B 3/26* | (2006.01) |

(52) U.S. Cl.

CPC ..... *B28B 7/386* (2013.01); *B08B 3/024* (2013.01); *B28B 3/26* (2013.01)

USPC ..... 134/22.18; 137/22.1

(58) Field of Classification Search

USPC ..... 134/22.1, 198

See application file for complete search history.

(56) References Cited

U.S. PATENT DOCUMENTS

| | | | | |
|---|---|---|---|---|
| 3,799,178 | A | 3/1974 | Anderson et al. | |
| 6,474,348 | B1 * | 11/2002 | Beggs et al. | 134/22.12 |
| 2005/0126596 | A1 * | 6/2005 | Wada et al. | 134/22.1 |

FOREIGN PATENT DOCUMENTS

| | | | |
|---|---|---|---|
| EP | 1 502 665 | A1 | 2/2005 |
| FR | 2576532 | A1 | 8/1986 |
| JP | 62-087792 | U | 6/1987 |
| JP | S62-87792 | | 6/1987 |
| JP | 03-281306 | A | 12/1991 |
| JP | 05-096602 | A | 4/1993 |
| JP | 05096602 | A * | 4/1993 |
| JP | 11-226523 | | 8/1999 |

(Continued)

OTHER PUBLICATIONS

English Machine Translation of JP 05-096602 A.*

(Continued)

*Primary Examiner* — Nicole Blan

(74) *Attorney, Agent, or Firm* — Sughrue Mion, PLLC

(57) ABSTRACT

A method for cleaning a die member having molding grooves and moldable-ceramic-material-supplying holes communicating with the molding grooves, by removing a binder-containing moldable ceramic material from the die member after used for molding the moldable ceramic material, comprising the steps of spraying a high-pressure fluid to a surface of the die member on the side of moldable-material-supplying holes, and then spraying a high-pressure fluid to a surface of the die member on the side of molding grooves, thereby removing the moldable ceramic material.

6 Claims, 3 Drawing Sheets

(56) References Cited

FOREIGN PATENT DOCUMENTS

| | | | | |
|---|---|---|---|---|
| JP | 11-226523 | A | | 8/1999 |
| JP | 2001-145856 | | | 5/2001 |
| JP | 2001-145856 | A | | 5/2001 |
| JP | 2001145856 | A | * | 5/2001 |
| JP | 2003-285014 | A | | 10/2003 |

OTHER PUBLICATIONS

English Machine Translation of JP 2001-145856 A.*
Chinese Office Action issued in Application No. 200780048066.6 dated Feb. 22, 2011.
Supplementary European Search Report issued in corresponding EP Application No. 07860253.9, dated Aug. 5, 2013.

* cited by examiner

DIE-MEMBER-CLEANING METHOD AND APPARATUS

CROSS-REFERENCE TO RELATED APPLICATIONS

This application is a National Stage of International Application No. PCT/JP2007/075024 filed Dec. 26, 2007, claiming priority based on Japanese Patent Application No. 2006-352463, filed Dec. 27, 2006, the contents of which are incorporated herein by reference in their entirety.

FIELD OF THE INVENTION

The present invention relates to a method and an apparatus for cleaning a die member for extrusion-molding a ceramic honeycomb structure.

BACKGROUND OF THE INVENTION

Ceramic honeycomb structures used for cleaning exhaust gases discharged from automobile engines, etc., are produced by extrusion-molding a moldable, plastic ceramic material comprising ceramic powder, a pore former, a molding aid such as a binder, water, etc. through a die member 50 as shown in FIGS. 4(*a*)-4(*c*), drying and sintering the resultant molding. In the extrusion molding, the moldable ceramic material is introduced into the molding die member 50 through moldable-material-supplying holes 51, and discharged as a honeycomb structure molding from grooves 52.

Because the grooves of the die member are extremely narrow, the repeated extrusion-molding of honeycomb structures results in clogging the grooves of the die member with foreign matter and high-hardness components in the moldable ceramic material. Because the use of a die member clogged with such foreign matter, etc. produces honeycomb structures with deteriorated quality, the periodic cleaning of the die member is needed. To clean this die member, a moldable ceramic material clogging holes and grooves should be removed together with foreign matter and high-hardness components. Thus used conventionally are a method of spraying high-pressure water only to holes, and a method of spraying high-pressure water only to grooves.

However, because the moldable ceramic material contains an organic binder, it cannot be sufficiently removed by spraying high-pressure water to only the holes or the grooves. When the high-pressure water is sprayed to the holes, the moldable ceramic material remaining in the grooves cannot be completely removed. On the other hand, when the high-pressure water is sprayed to the grooves, the pressure of the high-pressure water should be reduced to avoid troubles such as the deformation and damage of small grooves, or the die member is not sufficiently cleaned, or cleaning needs long time.

JP 2003-285014 A discloses a method for cleaning a die member by heating a die member having a molding material attached thereto at 200-500° C. to remove an organic binder from the molding material, and then spraying a fluid at a pressure of 40 kg/cm$^2$ or less to the die member to remove the molding material. However, the cleaning method described in JP 2003-285014 A suffers the problem that the die member is deformed by heating at 200-500° C., failing to keep the desired groove width. Particularly in the case of large molding die members of 200 mm or more in outer diameter, this problem is serious.

OBJECTS OF THE INVENTION

Accordingly, an object of the present invention is to provide a method and an apparatus for removing a binder-containing molding material attached to a die member with high efficiency without damaging or deforming the die member.

DISCLOSURE OF THE INVENTION

As a result of intense research in view of the above object, the inventors have found that high-pressure cleaning by spraying a high-pressure fluid onto a die member on both sides of moldable-material-supplying holes and molding grooves can remove a binder-containing molding material with high efficiency without damaging or deforming the die member. The present invention has been completed based on such finding.

Thus, the method of the present invention for cleaning a die member having molding grooves and moldable-ceramic-material-supplying holes communicating with the molding grooves, by removing a binder-containing moldable ceramic material from the die member after used for molding the moldable ceramic material, comprises the steps of spraying a high-pressure fluid to a surface of the die member on the side of the moldable-material-supplying holes substantially perpendicularly, and then spraying a high-pressure fluid to a surface of the die member on the side of the molding grooves substantially perpendicularly.

The pressure of the high-pressure fluid sprayed to the material-supplying holes is preferably higher than the pressure of the high-pressure fluid sprayed to the molding grooves.

After spraying the high-pressure fluid to the grooves, the high-pressure fluid is preferably sprayed to the holes again.

The pressure of the high-pressure fluid sprayed to the holes is preferably 7-20 MPa. The pressure of the high-pressure fluid sprayed to the grooves is preferably 1-5 MPa.

The width of each groove is preferably 0.1-0.5 mm. The diameter of each hole is preferably 1-2 mm.

The apparatus of the present invention for cleaning a die member having molding grooves and moldable-ceramic-material-supplying holes communicating with the molding grooves, by removing a binder-containing moldable ceramic material from the die member after used for molding the moldable ceramic material, comprises a die-member-holding mechanism, a high-pressure fluid nozzle, an air-blowing nozzle, and a nozzle-moving mechanism; the high-pressure fluid nozzle having a mechanism for spraying a high-pressure fluid onto a surface of the die member on the side of holes or grooves substantially perpendicularly while moving relative to the die member, thereby removing the moldable ceramic material; and the air-blowing nozzle having a mechanism for spraying high-pressure air onto a surface of the die member on the side of holes or grooves substantially perpendicularly while moving relative to the die member, thereby removing the fluid.

Said die-member-holding mechanism is preferably turned to an opposite direction.

Said nozzle-moving mechanism preferably comprises a servo motor, a ball screw or an LM guide.

It is preferable that the die member and the die-member-holding mechanism are placed in a booth, and that the nozzle-moving mechanism is disposed outside the booth, the inside of the booth and the nozzle-moving mechanism being separated by a flexible sheet.

BRIEF DESCRIPTION OF THE DRAWINGS

FIG. 4(*b*) is a schematic view showing a die member on the side of molding grooves, which is used in the cleaning method of the present invention.

FIG. 4(*c*) is a schematic cross-sectional view showing a die member used in the cleaning method of the present invention, in parallel with the longitudinal direction of the material-supplying holes.

DESCRIPTION OF THE PREFERRED EMBODIMENTS

[1] Die-Member-Cleaning Method

The method of the present invention for cleaning a die member having molding grooves and moldable-ceramic-material-supplying holes communicating with the molding grooves, by removing a binder-containing moldable ceramic material from the die member after used for molding the moldable ceramic material, comprises the steps of spraying a high-pressure fluid to a surface of the die member on the side of the moldable-material-supplying holes substantially perpendicularly, and then spraying a high-pressure fluid to a surface of the die member on the side of the molding grooves substantially perpendicularly.

Figure 4A:
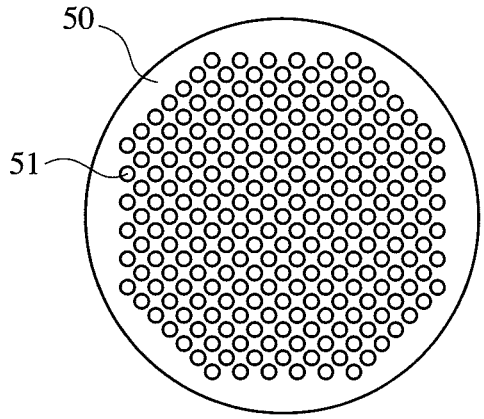
FIG. 4(*a*) is a schematic view showing a die member on the side of material-supplying holes, which is used in the cleaning method of the present invention.
Figure 4B:
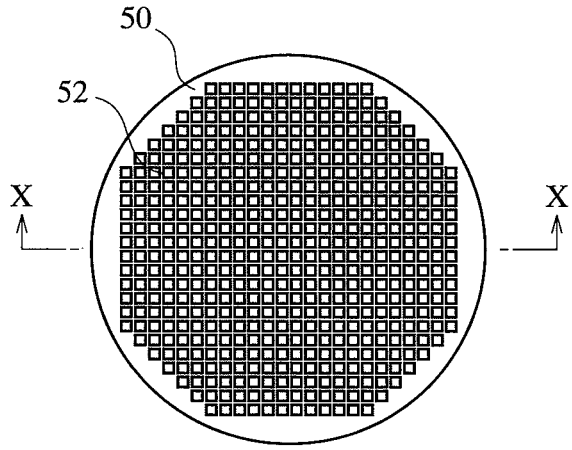
Figure 4C:
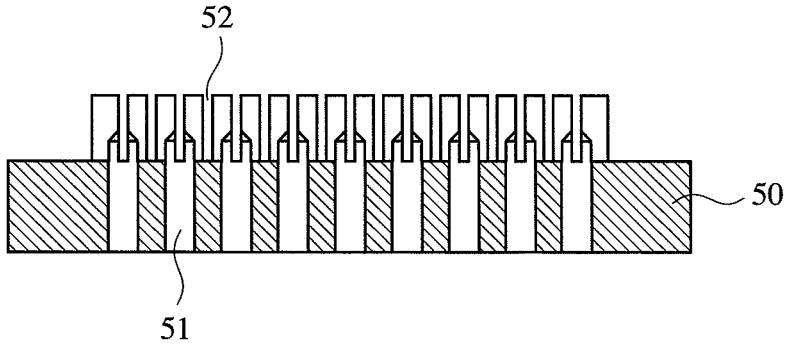

As shown in FIGS. 4(*a*) to 4(*c*), the die member has a large number of small grooves for molding, and moldable-material-supplying holes communicating with the grooves. A large number of small grooves are likely deformed by spraying a high-pressure fluid. On the other hand, the holes with wider intervals than those between the grooves are stronger than the grooves. Accordingly, by first spraying a high-pressure fluid to the holes to remove most of the moldable ceramic material attached to the die member, the cleaning of the grooves can be easily conducted without deformation.

Figure 3:
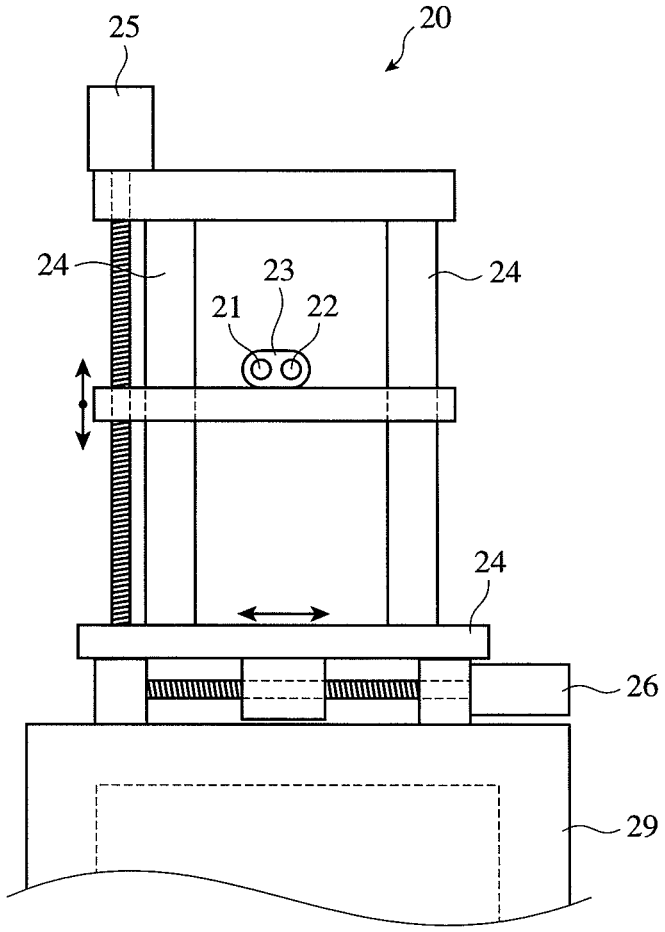
FIG. 3 is a schematic view showing one example of the nozzle-moving mechanisms in the cleaning apparatus of the present invention.

As shown in FIG. 3, because the holes of the die member have larger openings relative to the grooves, the pressure of a high-pressure fluid sprayed thereto can be higher than the spraying pressure to the grooves, so that a moldable ceramic material can be easily removed from the holes. Also, because the first cleaning of the holes by spraying a high-pressure fluid can remove most of the moldable ceramic material from the die member, the grooves can be cleaned by a lower-pressure fluid, thereby preventing the deformation of the grooves.

Because the moldable ceramic material may remain in the grooves or the holes even after their cleaning, a high-pressure fluid may be further sprayed to the holes to surely clean the die member. Thereafter, the groove-side surface of the die member may be cleaned again.

The pressure of the high-pressure fluid sprayed to the holes is preferably 7-20 MPa. With the pressure of 7-20 MPa, the die member can be cleaned without deformation. When the above pressure is less than 7 MPa, the moldable material remaining in the die member cannot sufficiently be removed. When the above pressure is more than 20 MPa, the die member may be deformed. The pressure of the high-pressure fluid sprayed to the holes is more preferably 8-15 MPa.

The pressure of the high-pressure fluid sprayed to the grooves is preferably 1-5 MPa. With the above pressure of 1-5 MPa, the die member can be cleaned without deformation. When the above pressure is less than 1 MPa, the moldable material remaining in the die member cannot sufficiently be removed. When the above pressure is more than 5 MPa, the die member may be deformed. The pressure of the high-pressure fluid sprayed to the grooves is more preferably 2.5-5 MPa.

Each molding groove preferably has a width of 0.1-0.5 mm. With the groove width of 0.1-0.5 mm, the high-pressure fluid can flow through the grooves to surely remove the moldable material from the grooves. When the groove width is less than 0.1 mm, the high-pressure fluid cannot easily flow through the grooves, resulting in low cleaning efficiency. When the groove width is more than 0.5 mm, the die member has low strength because of narrow groove gaps, so that the die member may be deformed by spraying a high-pressure fluid.

Each hole preferably has a diameter of 1-2 mm. With the hole diameter of 1-2 mm, the high-pressure fluid can flow through the holes to surely remove a moldable material from the grooves. When the hole diameter is less than 1 mm, the high-pressure fluid cannot easily flow through the holes, resulting in low cleaning efficiency. When the hole diameter is more than 2 mm, gaps between the holes are too narrow, providing the die member with low strength, and thus making it likely that the die member is deformed when the high-pressure fluid sprayed.

[2] Die-Member-Cleaning Apparatus

The apparatus of the present invention for cleaning a die member having molding grooves and moldable-ceramic-material-supplying holes communicating with the molding grooves, by removing a binder-containing moldable ceramic material from the die member after used for molding the moldable ceramic material, comprises a die-member-holding mechanism, a high-pressure fluid nozzle, an air-blowing nozzle, and a nozzle-moving mechanism; the high-pressure fluid nozzle having a mechanism for spraying a high-pressure fluid onto a surface of the die member on the side of holes or grooves substantially perpendicularly while moving relative to the die member, thereby removing the moldable ceramic material; and the air-blowing nozzle having a mechanism for spraying high-pressure air onto a surface of the die member on the side of holes or grooves substantially perpendicularly while moving relative to the die member, thereby removing the fluid.

With the above mechanisms of cleaning apparatus, a high-pressure fluid can surely flow into the holes and grooves of the die member, thereby surely removing the moldable material.

The die-member-holding mechanism is preferably turned to an opposite direction. With the die-member-holding mechanism turned, the die member need not be gripped again by the die-member-holding mechanism when the high-pressure fluid is sprayed to the grooves again after sprayed to the holes. Accordingly, with the die member once set to the die-member-holding mechanism, the spraying of the high-pressure fluid to the holes and the grooves can be conducted continuously and efficiently.

The nozzle-moving mechanism preferably comprises a servo motor, a ball screw or an LM guide. Using a servo motor, a ball screw or an LM guide in the nozzle-moving mechanism, the nozzle can move smoothly, and the high-pressure fluid can accurately be sprayed to the holes and the grooves, surely removing the moldable material from the die member.

It is preferable that the die member and the die-member-holding mechanism are disposed in a booth, and that the nozzle-moving mechanism is disposed outside the booth, the inside of the booth and the nozzle-moving mechanism being separated by a flexible sheet. Such structure prevents a fluid and a moldable material scattered when spraying the high-pressure fluid to the die member from attaching to the nozzle-moving mechanism, avoiding troubles such as breakdown, etc.

The fluid used for cleaning may be water, steam, organic solvents such as alcohol, mixed water/alcohol solvents, etc., and water or steam is preferable.

[3] Moldable Ceramic Materials

The ceramic materials may be silicon carbide, silicon nitride, cordierite, alumina, mullite, silicon nitride, sialon, silicon carbide, aluminum nitride, zirconia, aluminum titanate, etc. The cleaning method of the present invention is effective for a die member after moldable ceramic materials comprising the ceramic materials and binders such as methylcellulose, hydroxypropyl methylcellulose, etc., and water are extrusion-molded. Because the organic-binder-containing moldable ceramic material strongly attaches to the die member, it cannot be easily removed by usual methods. The moldable ceramic material may contain surfactants and pore formers such as carbon, if necessary.

The present invention will be explained in more detail referring to Examples below without intention of restricting the scope of the present invention.

Example 1

Kaolin powder, talc powder, silica powder and alumina powder were mixed to prepare cordierite-forming material powder comprising 50% by mass of $SiO_2$, 35% by mass of $Al_2O_3$ and 15% by mass of MgO. This powder was mixed with methylcellulose and hydroxypropyl methylcellulose as binders, a lubricant, and graphite as a pore former. After thorough dry-blending, water was added to carry out sufficient kneading to prepare plasticized, moldable ceramic material. This moldable material was extrusion-molded to a ceramic honeycomb structure, using a die member having a molding groove width of 0.3 mm, a groove pitch (distance between two corresponding points in adjacent grooves) of 1.5 mm, and an hole diameter of 1.5 mm as shown in FIGS. 4(*a*) and 4(*b*).

Figure 1:
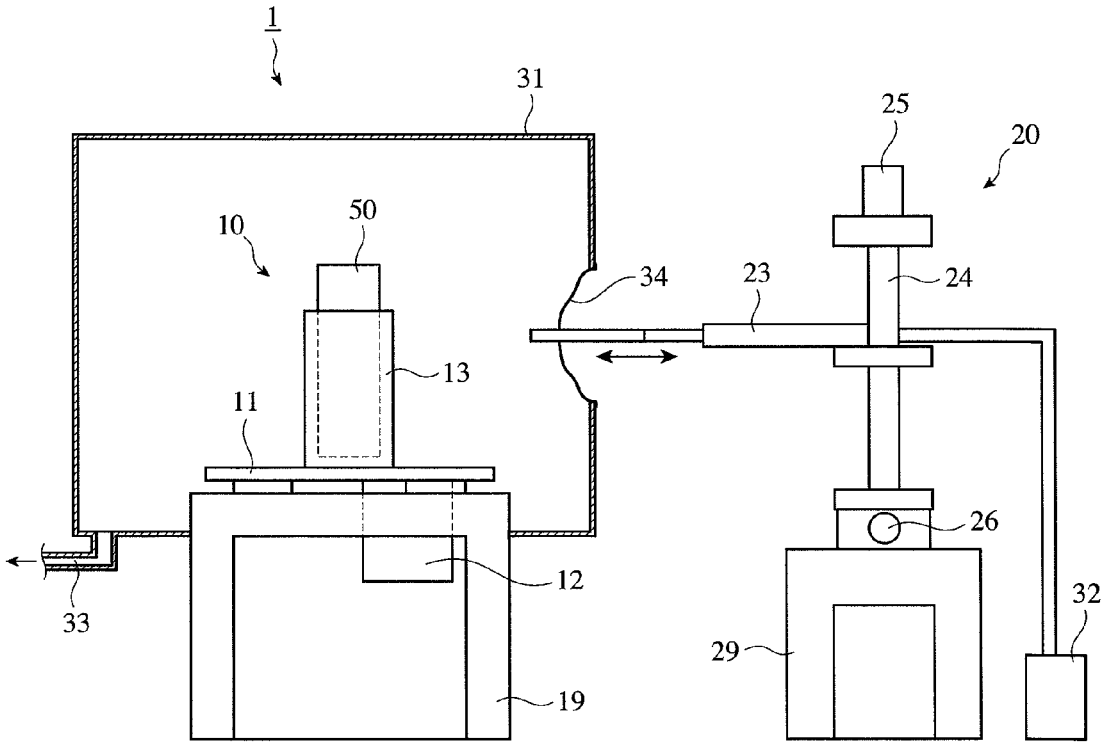
FIG. 1 is a schematic view showing one example of the cleaning apparatuses of the present invention.
Figure 2:
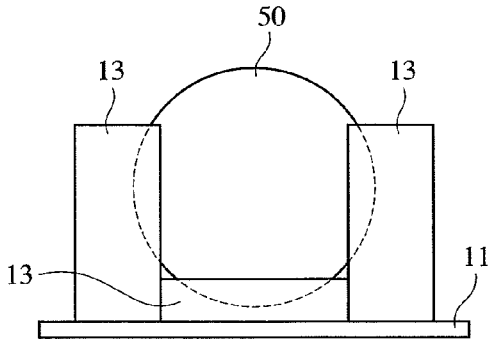
FIG. 2 is a schematic view showing one example of the die-holding mechanisms in the cleaning apparatus of the present invention.

The die member used in the extrusion-molding was cleaned by a die-member-cleaning apparatus 1 shown in FIG. 1. The die-member-cleaning apparatus 1 comprises a die-member-holding mechanism 10 comprising a base frame 19, a table plate 11 disposed on the base frame 19, a jig 13 disposed on the table plate 11 for fixing a die member 50, and a motor 12 for turning the table plate 11; a nozzle-moving mechanism 20 comprising a support table 29, a guide 24 disposed on the support table 29, a nozzle 23 mounted onto the guide 24 and comprising a high-pressure fluid nozzle 21 and an air-blowing nozzle 22, and motors 25, 26 attached to upper and lower ends of the guide 24; and a booth 31 for covering the die-member-holding mechanism 10. An opening of the booth 31, through which the nozzle 23 is inserted, is provided with a plastic cover 34 for preventing a cleaning fluid and a removed moldable material from attaching to the nozzle-moving mechanism 20, while ensuring the movement of the nozzle 23. The die member 50 is fixed by a jig 13 disposed on the table plate 11 as shown in FIG. 2. The nozzle 23 is movable vertically by the motor 25 and laterally by the motor 26 as shown in FIG. 3. After cleaning, a waste liquid is discharged through a drainage pipe 33.

The die member 50 was first fixed by the jig 13, such that an hole-side surface of the die member 50 faces the nozzle 23 in the nozzle-moving apparatus 20 substantially perpendicularly. Next, (a) the holes 51 of the die member 50 were cleaned by spraying a water-containing, high-pressure fluid from the high-pressure fluid nozzle 21 (diameter: 2 mm) of the nozzle-moving apparatus 20 to the holes 51 at a pressure of 6 MPa, while relatively moving the nozzle 21 horizontally. (b) When the horizontal cleaning was completed, the nozzle 21 was moved vertically to continue cleaning while relatively the nozzle 21 horizontally in an opposite direction. These operations (a) and (b) were repeated to clean an entire hole-side surface of the die member 50. The table plate 11 was then turned such that the groove-side surface of the die member faced the nozzle 23 of the nozzle-moving apparatus 20 substantially perpendicularly. A high-pressure fluid was sprayed from the nozzle 21 onto the grooves 52 at a pressure of 0.9 MPa, to clean the groove-side surface like the hole-side surface. The distance between each surface of the die member and the nozzle was 200 mm.

Examples 2-25, and Comparative Examples 3-5

A die member used in the extrusion-molding was cleaned in the same manner as in Example 1, except for changing the shape of the die member, the pressure of the high-pressure fluid during cleaning, and cleaning conditions as shown in Table 1. In Table 1, the passage of "holes→grooves→holes" in the cleaning method in Example 24 means that the hole-side surface and the groove-side surface were cleaned, and the hole-side surface was cleaned again. The passage of "holes→grooves→holes→grooves" in the cleaning method in Example 25 means that the groove-side surface was further cleaned again.

Comparative Example 1

A die member used in the extrusion-molding was cleaned in the same manner as in Example 1, except for changing the shape of the die member, the pressure of the high-pressure fluid during cleaning, and cleaning conditions as shown in Table 1, and cleaning only the groove-side surface. Comparative Example 1 used a conventional high-pressure cleaning method.

Comparative Example 2

A die member used in the extrusion-molding was cleaned in the same manner as in Example 1, except for changing the shape of the die member, the pressure of the high-pressure fluid during cleaning, and cleaning conditions as shown in Table 1, and cleaning only the hole-side surface. Comparative Example 2 used a conventional high-pressure cleaning method.

Evaluation of Cleanability

The grooves and holes of the cleaned die members were observed by the naked eye to examine cleaning residues, and the cleanability was evaluated according to the following standard. The results are shown in Table 1.

Excellent: No cleaning residues.

Good: There were slight cleaning residues, causing no problems in use for extrusion molding.

Poor: There were such cleaning residues that the die member could not be used for extrusion molding.

Evaluation of Deformation of Die Member

The deformation of the cleaned die members was evaluated as follows. The results are shown in Table 1.

Excellent: No deformation in the die member.

Good: There was slight deformation in the die member, causing no problems in use for extrusion molding.

Poor: The die member was so deformed that it could not be used for extrusion molding.

TABLE 1

| | Shape of Die Member | | | Pressure of High-Pressure Fluid (MPa) | |
|---|---|---|---|---|---|
| | Groove | | Aperture | | |
| No. | Width (mm) | Groove Pitch (mm) | Diameter (mm) | Aperture-side | Groove-side |
| Example 1 | 0.3 | 1.5 | 1.5 | 6 | 0.9 |
| Example 2 | 0.3 | 1.5 | 1.5 | 7 | 1.0 |
| Example 3 | 0.3 | 1.5 | 1.5 | 7 | 2.5 |
| Example 4 | 0.3 | 1.5 | 1.5 | 7 | 5.0 |
| Example 5 | 0.3 | 1.5 | 1.5 | 8 | 1.0 |
| Example 6 | 0.3 | 1.5 | 1.5 | 8 | 2.5 |
| Example 7 | 0.3 | 1.5 | 1.5 | 8 | 5.0 |
| Example 8 | 0.3 | 1.5 | 1.5 | 10 | 2.0 |
| Example 9 | 0.3 | 1.5 | 1.5 | 10 | 2.0 |
| Example 10 | 0.3 | 1.5 | 1.5 | 10 | 2.5 |
| Example 11 | 0.3 | 1.5 | 1.5 | 10 | 5.0 |
| Example 12 | 0.3 | 1.5 | 1.5 | 15 | 1.0 |
| Example 13 | 0.3 | 1.5 | 1.5 | 15 | 3.0 |
| Example 14 | 0.3 | 1.5 | 1.5 | 15 | 5.0 |
| Example 15 | 0.3 | 1.5 | 1.5 | 20 | 1.0 |
| Example 16 | 0.3 | 1.5 | 1.5 | 20 | 5.0 |
| Example 17 | 0.3 | 1.5 | 1.5 | 22 | 1.0 |
| Example 18 | 0.3 | 1.5 | 1.5 | 22 | 6.0 |
| Example 19 | 0.3 | 1.5 | 2.0 | 10 | 2.5 |
| Example 20 | 0.1 | 1.0 | 1.0 | 10 | 2.0 |
| Example 21 | 0.1 | 1.3 | 2.0 | 10 | 2.0 |
| Example 22 | 0.5 | 1.8 | 1.0 | 10 | 2.0 |
| Example 23 | 0.5 | 1.8 | 2.0 | 10 | 2.0 |
| Example 24 | 0.3 | 1.5 | 1.5 | 7 | 1 |
| Example 25 | 0.3 | 1.5 | 1.5 | 7 | 1 |
| Comparative Example 1 | 0.3 | 1.5 | 1.5 | — | 15 |
| Comparative Example 2 | 0.3 | 1.5 | 1.5 | 15 | — |
| Comparative Example 3 | 0.3 | 1.5 | 1.5 | 15 | 3 |
| Comparative Example 4 | 0.3 | 1.5 | 1.5 | 15 | 15 |
| Comparative Example 5 | 0.3 | 1.5 | 1.5 | 10 | 15 |

| | | Evaluation of Cleaning | |
|---|---|---|---|
| No. | Cleaning Method | Cleanability | Deformation of Die Member |
| Example 1 | Apertures → Grooves | Good | Excellent |
| Example 2 | Apertures → Grooves | Good | Excellent |
| Example 3 | Apertures → Grooves | Excellent | Excellent |
| Example 4 | Apertures → Grooves | Excellent | Excellent |
| Example 5 | Apertures → Grooves | Good | Excellent |
| Example 6 | Apertures → Grooves | Excellent | Excellent |
| Example 7 | Apertures → Grooves | Excellent | Excellent |
| Example 8 | Apertures → Grooves | Good | Excellent |
| Example 9 | Apertures → Grooves | Excellent | Excellent |
| Example 10 | Apertures → Grooves | Excellent | Excellent |
| Example 11 | Apertures → Grooves | Excellent | Excellent |
| Example 12 | Apertures → Grooves | Good | Excellent |
| Example 13 | Apertures → Grooves | Excellent | Excellent |
| Example 14 | Apertures → Grooves | Excellent | Excellent |
| Example 15 | Apertures → Grooves | Good | Excellent |
| Example 16 | Apertures → Grooves | Excellent | Good |
| Example 17 | Apertures → Grooves | Good | Good |
| Example 18 | Apertures → Grooves | Excellent | Good |
| Example 19 | Apertures → Grooves | Excellent | Good |
| Example 20 | Apertures → Grooves | Good | Excellent |
| Example 21 | Apertures → Grooves | Good | Good |
| Example 22 | Apertures → Grooves | Good | Good |
| Example 23 | Apertures → Grooves | Good | Good |
| Example 24 | Apertures → Grooves → Apertures | Good | Excellent |
| Example 25 | Apertures → Grooves → Apertures → Grooves | Excellent | Excellent |
| Comparative Example 1 | Only grooves | Poor | Poor |
| Comparative Example 2 | Only holes | Poor | Excellent |
| Comparative Example 3 | Grooves → Apertures | Poor | Excellent |
| Comparative Example 4 | Grooves → Apertures | Excellent | Poor |
| Comparative Example 5 | Grooves → Apertures | Excellent | Poor |

As shown in Table 1, the die members were cleaned substantially without deformation in Examples 1-25 using the method of the present invention. On the other hand, the die members of Comparative Examples 1-5 had cleaning residues or deformation, failing to be used for extrusion molding.

EFFECT OF THE INVENTION

By the cleaning method and apparatus of the present invention, binder-containing molding materials can be removed from the die member with high efficiency without damage or deformation.

What is claimed is:

1. A method for cleaning a die member having molding grooves and moldable-ceramic-material-supplying holes communicating with the molding grooves, after used for molding a binder-containing moldable ceramic material, consisting essentially of the step of removing said binder-containing moldable ceramic material from said die member by first spraying a high-pressure fluid to a surface of said die member on the side of said moldable-material-supplying holes substantially perpendicularly, and then spraying a high-pressure fluid to a surface of said die member on the side of said molding grooves substantially perpendicularly, wherein the pressure of the high-pressure fluid sprayed to said holes is 8-20 MPa, and wherein the intervals between each of the holes are wider than the intervals between each of the grooves.

2. The method for cleaning a die member according to claim 1, wherein the pressure of the high-pressure fluid sprayed to said holes is higher than the pressure of the high-pressure fluid sprayed to said grooves.

3. The method for cleaning a die member according to claim 1, wherein after spraying the high-pressure fluid to said grooves, the high-pressure fluid is sprayed to said holes again.

4. The method for cleaning a die member according to claim 1, wherein the pressure of the high-pressure fluid sprayed to said grooves is 1-5 MPa.

5. The method for cleaning a die member according to claim 1, wherein the width of each groove is 0.1-0.5 mm.

6. The method for cleaning a die member according to claim 1, wherein the diameter of each hole is 1-2 mm.

* * * * *